US007775070B2

(12) United States Patent
Lim et al.

(10) Patent No.: US 7,775,070 B2
(45) Date of Patent: Aug. 17, 2010

(54) DOOR POWER INTERRUPTION SAFETY SWITCH OF WASHING MACHINE AND METHOD OF OPERATION THEREOF

(75) Inventors: Min Kyu Lim, Jinhae-si (KR); In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 807 days.

(21) Appl. No.: 10/553,130

(22) PCT Filed: May 17, 2005

(86) PCT No.: PCT/KR2005/001431

§ 371 (c)(1),
(2), (4) Date: Dec. 27, 2006

(87) PCT Pub. No.: WO2006/004317

PCT Pub. Date: Jan. 12, 2006

(65) Prior Publication Data

US 2007/0209411 A1 Sep. 13, 2007

(30) Foreign Application Priority Data

May 20, 2004 (KR) ..... 10-2004-0036066
May 20, 2004 (KR) ..... 10-2004-0036067

(51) Int. Cl.
*D06F 39/00* (2006.01)

(52) U.S. Cl. ..... 68/12.26; 8/147

(58) Field of Classification Search ..... 8/147; 68/12.26
See application file for complete search history.

(56) References Cited

U.S. PATENT DOCUMENTS

| | | | | |
|---|---|---|---|---|
| 4,074,545 | A | 2/1978 | Case | |
| 4,449,383 | A * | 5/1984 | Cartier | 68/12.06 |
| 6,082,787 | A * | 7/2000 | Chioffi et al. | 292/128 |
| 6,363,563 | B1 * | 4/2002 | Range et al. | 8/159 |
| 6,634,684 | B2 * | 10/2003 | Spiessl | 292/341.16 |
| 2004/0083769 | A1 * | 5/2004 | Kim et al. | 68/12.02 |
| 2004/0104580 | A1 * | 6/2004 | Spiessl et al. | 292/84 |

FOREIGN PATENT DOCUMENTS

| | | | |
|---|---|---|---|
| EP | 965677 | A1 * | 12/1999 |
| GB | 2 015 070 | | 9/1979 |
| GB | 2128283 | A * | 4/1984 |
| GB | 2232755 | A * | 12/1990 |

* cited by examiner

*Primary Examiner*—Michael Barr
*Assistant Examiner*—Charles W Kling
(74) *Attorney, Agent, or Firm*—McKenna Long & Aldridge LLP

(57) ABSTRACT

Door lock switch of washing apparatus, and method for controlling the same, the door lock switch for locking or unlocking a door, and cutting off a current applied to electric driving units under operation when the door is opened forcibly, thereby controlling electric driving units under operation effectively for improving operation efficiency and safety of the washing apparatus when the door is opened forcibly.

4 Claims, 13 Drawing Sheets

DOOR POWER INTERRUPTION SAFETY SWITCH OF WASHING MACHINE AND METHOD OF OPERATION THEREOF

This application claims priority to International Application No. PCT/KR2005/001431 filed on May 17, 2005, as well as Korean Applications P 2004-36066 filed on May 20, 2004 and P 2004-36067 filed on May 20, 2004, all of which are incorporated by reference, as if fully set forth herein.

TECHNICAL FIELD

The present invention relates to a door lock switch of a washing apparatus, and a method for controlling the same, and more particularly, to a door lock switch of a washing apparatus, and a method for controlling the same, in which electric driving units under operation are controlled effectively when a door is forcibly opened, for improving operation efficiency and safety of the washing apparatus.

BACKGROUND ART

The washing apparatus washes laundry through steps of washing, rinsing, and spinning to remove dirt from clothes and beddings in a drum by actions of water and detergent supplied to a tub.

In general, the washing apparatus washes laundry through steps of washing, rinsing, and spinning to remove dirt from clothes and beddings (hereafter called as 'cloth') by actions of water having detergent dissolved therein or clean water (hereafter called as 'washing water').

FIG. 1 illustrates a perspective view of a related art washing machine, and FIG. 2 illustrates a block diagram of a related art washing machine control.

Referring to FIGS. 1 and 2, the related art washing machine is provided with a body 2 having an opening for introduction/taking out laundry therethrough, a tub (not shown) supported on an inside of the body 2, a drum 10 rotatably mounted on an inside of the tub, a motor 12 for rotating the drum 10, a water supplying unit 14 for supplying washing water to the tub, and a drain unit 16 for draining the washing water from the tub.

The related art washing machine is also provided with a door 4 for opening/closing the opening, and a door lock switch 6 for locking/unlocking of the door 4.

The door 4 has a hook 5, so that the door closes/opens the opening as the hook 5 is locked or unlocked by the door lock switch 6.

Meanwhile, there can be a case when the door 4 is forcibly opened in the middle of washing, rinsing, or spinning of the laundry.

In this instance, for effective control of the washing apparatus, and the safety of a user, detection of the forced opening of the door 4 and subsequent appropriate control of the electric driving units, such as the motor under operation, or a water supply valve, are required.

However, the related art washing apparatus requires a door sensing switch (not shown) in addition to the door lock switch 6 for sensing the forced opening of the door 4 in the middle of washing, rinsing, or spinning of the laundry.

That is, the additional door sensing switch leads the washing apparatus complicate, to increase assembly man-hours, and a production cost.

Moreover, even if the door sensing switch is provided additionally, control of the electric driving units according to a state of sensing at the door sensing switch is very complicate and inefficient.

DISCLOSURE

Technical Problem

The object of the present invention is to provide a door lock switch of a washing apparatus, and a method for controlling the same, in which a door lock switch which locks or unlocks a door senses forced opening of the door directly, to cut off a current to electric driving units under operation, for simplifying a structure of the washing apparatus, and improving operation efficiency, and safety of the washing apparatus.

Technical Solution

The object of the present invention can be achieved by providing a door lock switch for locking or unlocking a door, and cutting off a current applied to electric driving units under operation when the door is opened forcibly.

In another aspect of the present invention, a door lock switch includes a switch casing, a slider for making a hook on a door to be held at or released from the switch casing, a locking pin for making the slider locked or unlocked, a bimetal for moving the locking pin to a locking, or unlocking position of the slider, a switch to be closed when the locking pin moves to the locking position of the slider, and a safety lever for opening the switch when the door is opened forcibly.

In another aspect of the present invention, a washing apparatus includes a body forming an exterior of the washing apparatus, an opening in a front surface of the body, a door for opening/closing the opening, a hook on the door, a switch casing on the body in correspondence to the hook on the door, a slider for making the hook on the door being locked or unlocked at the switch casing, a locking pin for locking or unlocking the slider, a bimetal for making the locking pin to move to a locking position or unlocking position of the slider, a switch to be closed when the locking pin moves to the locking position of the slider, and a safety lever for opening the switch when the door is opened forcibly.

The safety lever has one end rotatably connected to the switch casing, and the other end extended so as to be in contact with the hook of the door, and includes a projection at a position opposite to the locking pin for pressing down the locking pin.

The safety lever further includes a rotation delay portion provided to the other end of the safety lever for delaying rotation of the safety lever so that interference between the slider and the projection is prevented when the door is opened.

The washing apparatus further includes a return spring such that the safety lever has a restoring force in a direction the door is opened.

The washing apparatus further includes a heater for making thermal deformation of the bimetal.

The switch includes a fixed contact electrically connected to the electric driving units, and a movable contact electrically connected to a current supply portion for supplying a current to the electric driving units.

The washing apparatus further includes a solenoid for deforming the bimetal to make the locking pin to move to the locking position or the unlocking position of the slider.

The solenoid includes a plunger for deforming the bimetal in reaction to a magnetic field, and a coil wound on the plunger for forming the magnetic field as the current is applied thereto.

In another aspect of the present invention, a method for controlling a washing apparatus includes the step of cutting off a current to electric driving units under operation if a door lock switch which locks or unlocks a door senses forced opening of the door.

In another aspect of the present invention, a method for controlling a washing apparatus having a body forming an exterior thereof, electric driving units provided to the body, an opening in a front surface of the body, a door for opening/closing the opening, a door lock switch for locking/unlocking the door, and a switch in the door lock switch for being closed when the door is locked at the door lock switch to supply a current to the electric driving units, includes the step of the door lock switch sensing forced opening of the door, and opening the switch to cut off the current to the electric driving units under operation when the forced opening of the door is sensed.

In another aspect of the present invention, a method for controlling a washing apparatus having a body forming an exterior thereof, electric driving units provided to the body, a door for opening/closing an opening in the body, a hook on the door, a switch casing on the body in correspondence to the hook on the door, a slider for making the hook on the door to be locked/unlocked at the switch casing, a locking pin for locking/unlocking the slider, a bimetal for moving the locking pin to a locking or unlocking position of the slider, a switch designed to be closed when the locking pin moves to the locking position of the slider, and a safety lever for opening the switch, includes a first step of locking the door to close the switch, a second step of applying a current to the electric driving units as the switch is closed, a third step of opening the door forcibly, to open the switch, and a fourth step of cutting off the current to the electric driving units as the switch is opened.

The first step includes the step of locking the door to make the locking pin to move to the locking position of the slider by thermal deformation of the bimetal, to close the switch.

The thermal deformation of the bimetal is made by heat generated at a heat source, such as a heat.

The third step includes the step of opening the door forcibly, to make the locking pin to move to the unlocking position of the slider by the safety lever to open the switch.

The electric driving units are devices which use electricity as power sources, such as a motor for rotating a drum, or a water supply valve for supplying water to a tub.

In another aspect of the present invention, a method for controlling a washing apparatus having a body forming an exterior thereof, electric driving units provided to the body, a door for opening/closing an opening in the body, a hook on the door, a switch casing on the body in correspondence to the hook on the door, a slider for making the hook on the door to be locked/unlocked at the switch casing, a locking pin for locking/unlocking the slider, a bimetal for moving the locking pin to a locking or unlocking position of the slider, a solenoid for deforming the bimetal to make the locking pin to move to the locking or unlocking position of the slider, a switch designed to be closed when the locking pin moves to the locking position of the slider, and a safety lever for opening the switch, includes a first step of locking the door to close the switch, a second step of applying a current to the electric driving units as the switch is closed, a third step of opening the door forcibly, to open the switch, and a fourth step of cutting off the current to the electric driving units as the switch is opened.

The first step includes the step of locking the door to make the locking pin to move to the locking position of the slider by thermal deformation of the bimetal and operation of the solenoid, to close the switch.

The thermal deformation of the bimetal is made by heat generated at a heat source, such as a heat, and the solenoid acts toward a direction of the thermal deformation of the bimetal as a current is applied thereto.

The third step includes the step of opening the door forcibly, to make the locking pin to move to the unlocking position of the slider by the safety lever to open the switch.

The electric driving units are devices which use electricity as power sources, such as a motor for rotating a drum, or a water supply valve for supplying water to a tub.

ADVANTAGEOUS EFFECTS

According to the door lock switch of a washing apparatus, and method for controlling the same of the present invention, the direct sensing of forced opening of the door with the door lock switch which locks/unlocks the door, and cutting off of a current to the electric driving units under operation with the door lock switch permits a structure of the washing apparatus simple, and to improve operation efficiency and safety of the washing apparatus.

Moreover, the simplification of a structure of the washing apparatus for sensing forced open of the door permits to reduce assembly man-hours of the washing apparatus, as well as a fabrication time period and cost.

Thus, the door lock switch of a washing apparatus, and method for controlling the same of the present invention has very high industrial applicability.

DESCRIPTION OF DRAWINGS

The accompanying drawings, which are included to provide a further understanding of the invention, illustrate embodiment(s) of the invention and together with the description serve to explain the principle of the invention. In the drawings.

BEST MODE

Reference will now be made in detail to the preferred embodiments of the present invention, examples of which are illustrated in the accompanying drawings. Wherever possible, the same reference numbers will be used throughout the drawings to refer to the same or like parts.

Figure 1:
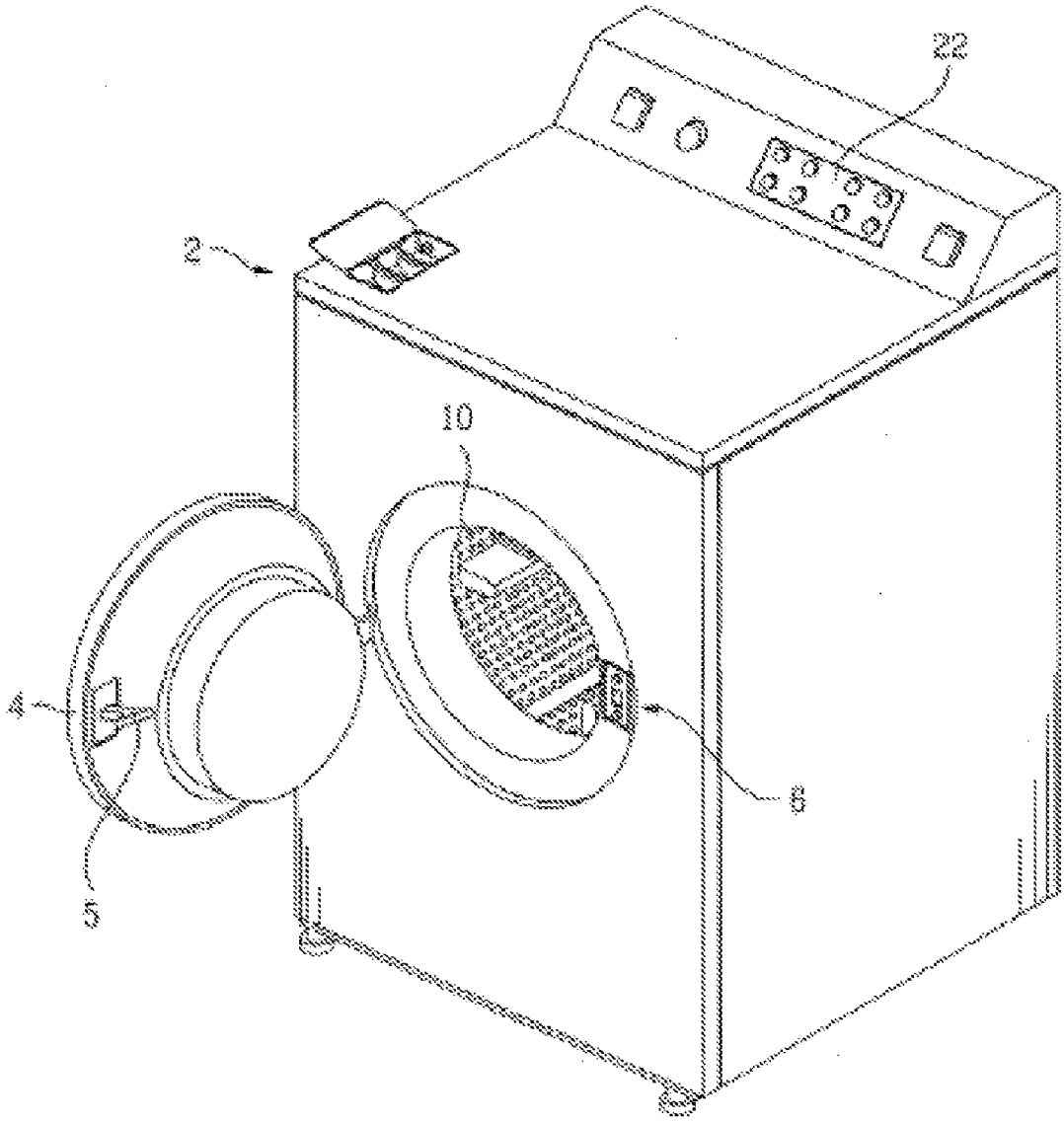
FIG. 1 RELATED ART
FIG. 1 illustrates a perspective view of a related art washing apparatus.
Figure 2:
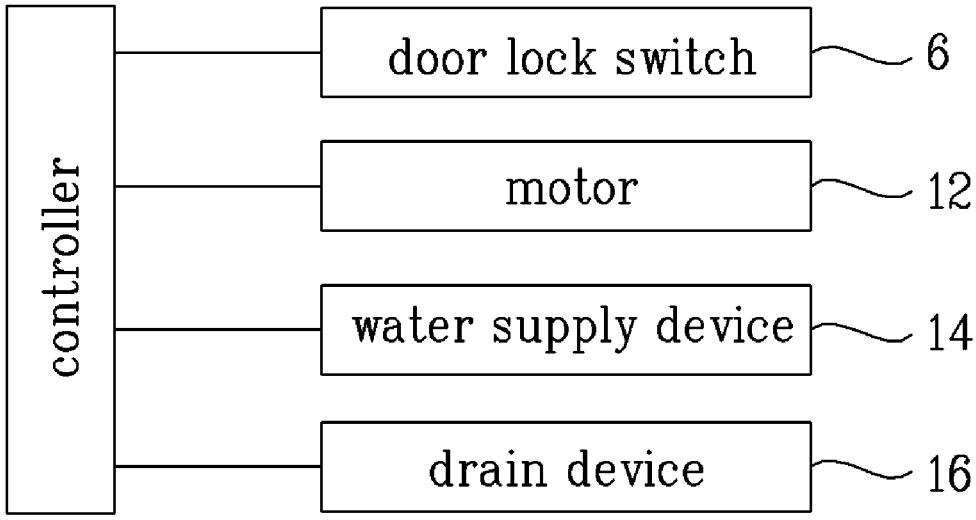
FIG. 2 RELATED ART
FIG. 2 illustrates a block diagram of a related art washing machine control.
Figure 3:
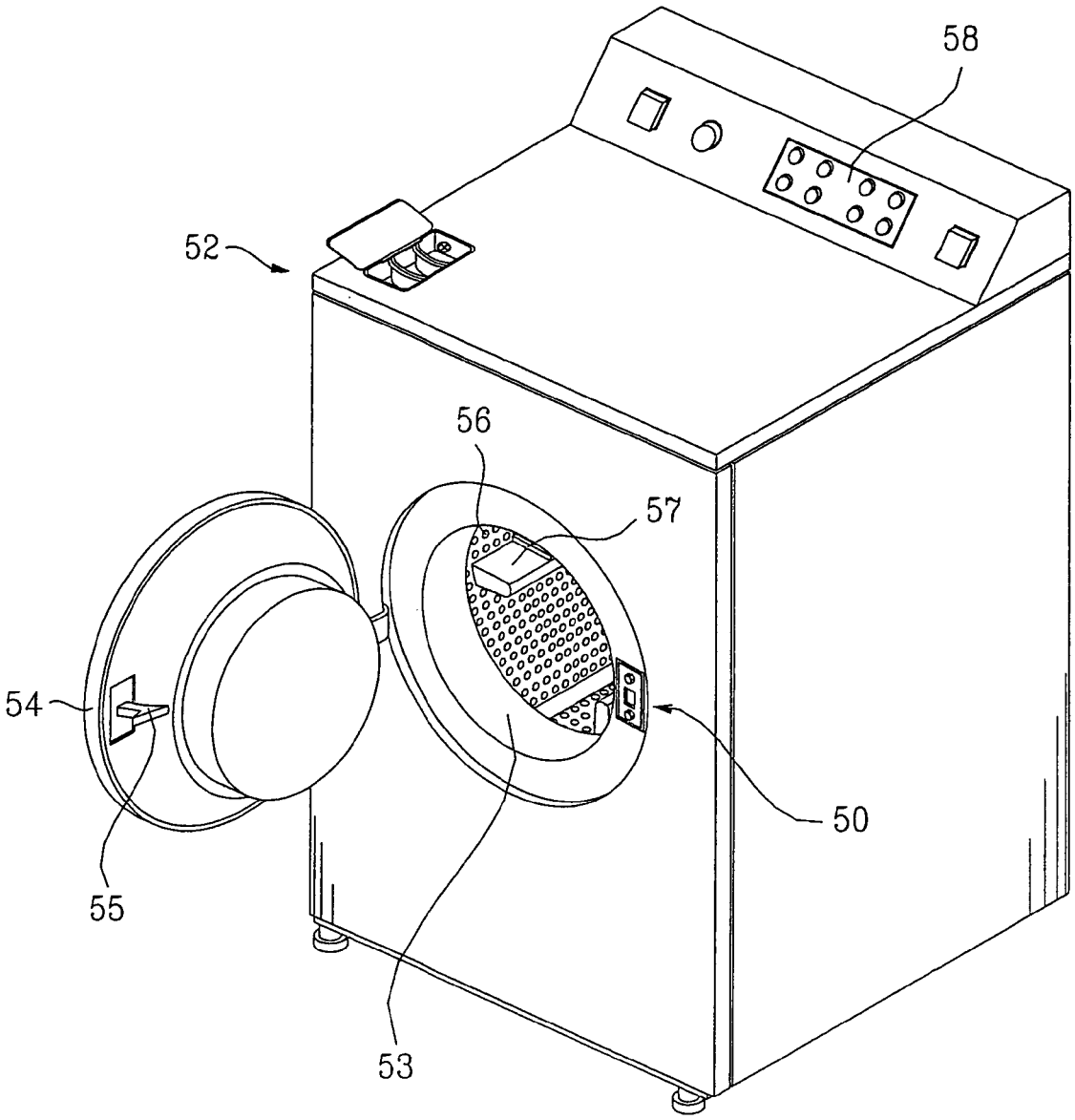
FIG. 3 illustrates a perspective view of a door lock switch of a washing apparatus in accordance with a preferred embodiment of the present invention.

FIG. 3 illustrates a perspective view of a door lock switch of a washing apparatus in accordance with a preferred embodiment of the present invention.

Referring to FIG. 3, the door lock switch 50 is mounted at one side of an opening 53 in the body 52 of the washing apparatus, for locking, or unlocking of a hook 55 on a door 54 for opening/closing the opening 53.

It is designed that, when the door 54 is forcibly opened, the door lock switch 50 cuts off a current to electric driving units that use electricity as a power source, such as a motor (not shown) for rotating the drum 56, a water supply valve for supplying water to a tub (not shown), or a drain pump for draining water from the tub.

In the meantime, the drum 56 has lifters 57 on an inside circumferential surface of enhancing a washing effect, and the body 52 has a control panel mounted on a rear of a top for controlling the washing apparatus.

A structure of the door lock switch 50 will be described in more detail with reference to FIGS. 4 to 7.

Figure 4:
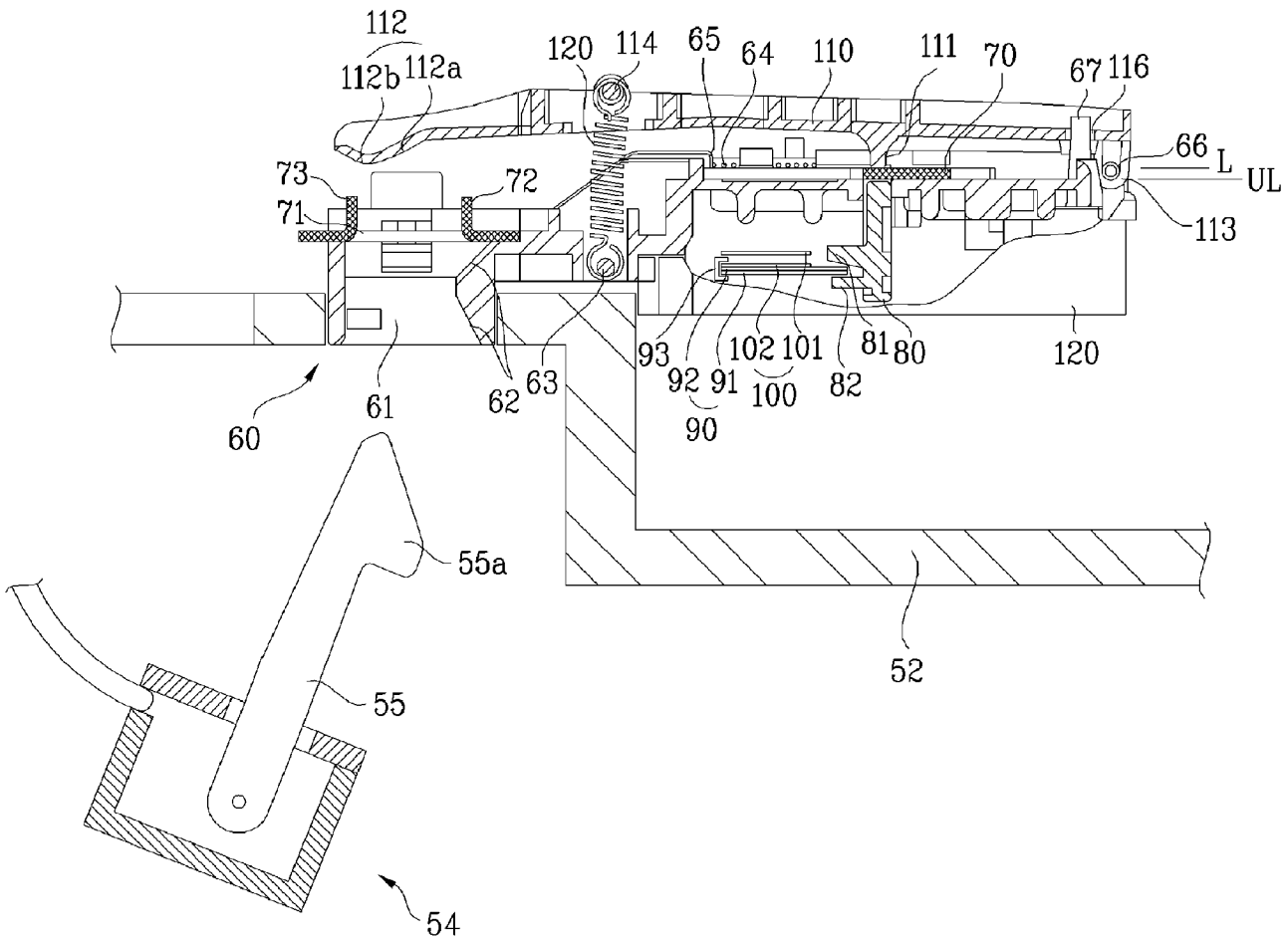
FIG. 4 illustrates a section of a door lock switch at the time of unlocking of the door in FIG. 3.
Figure 5:
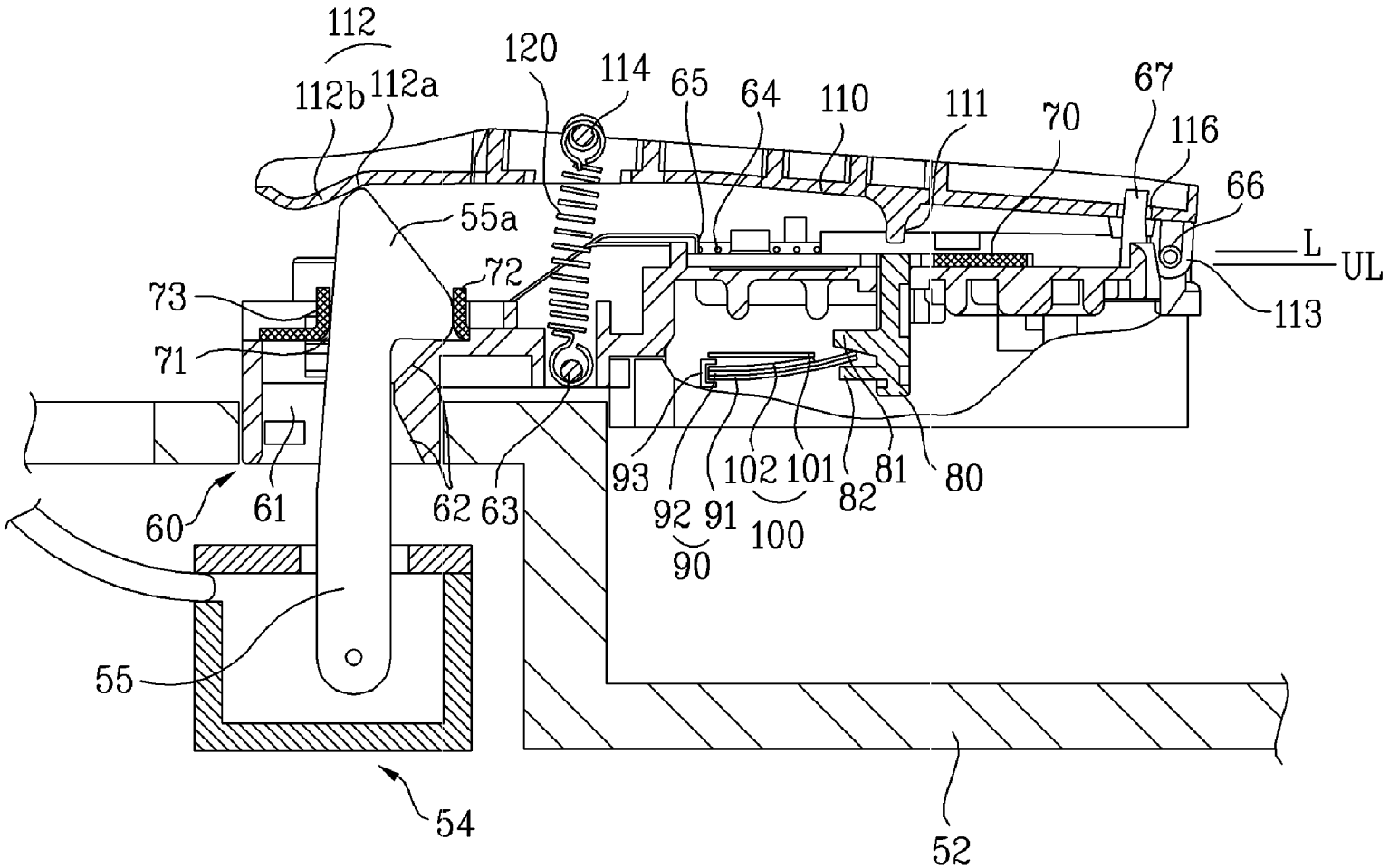
FIG. 5 illustrates a section of a door lock switch at the time of locking of the door in FIG. 3.
Figure 6:
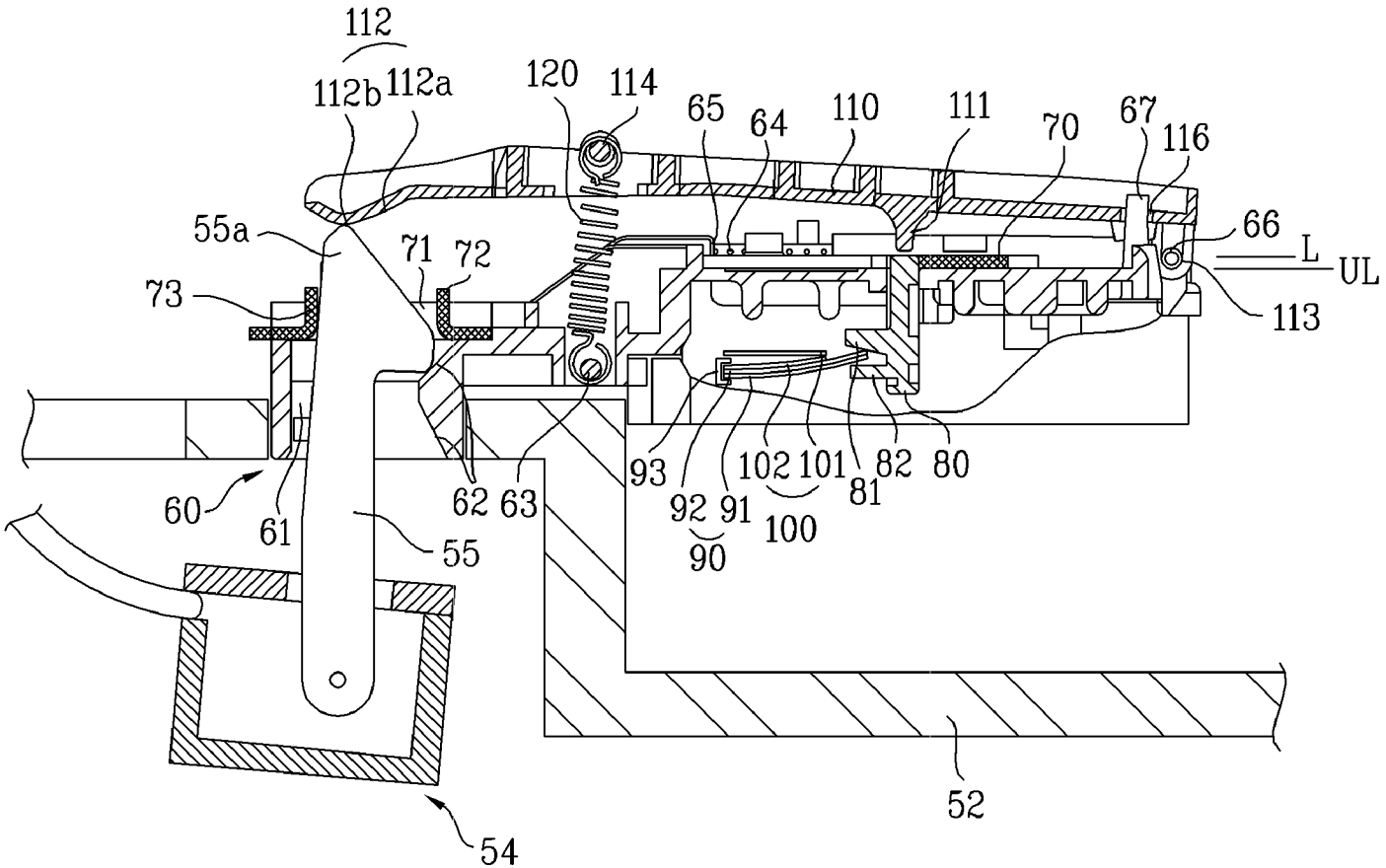
FIG. 6 illustrates a section of a door lock switch at the time of forced opening of the door in FIG. 3.
Figure 7:
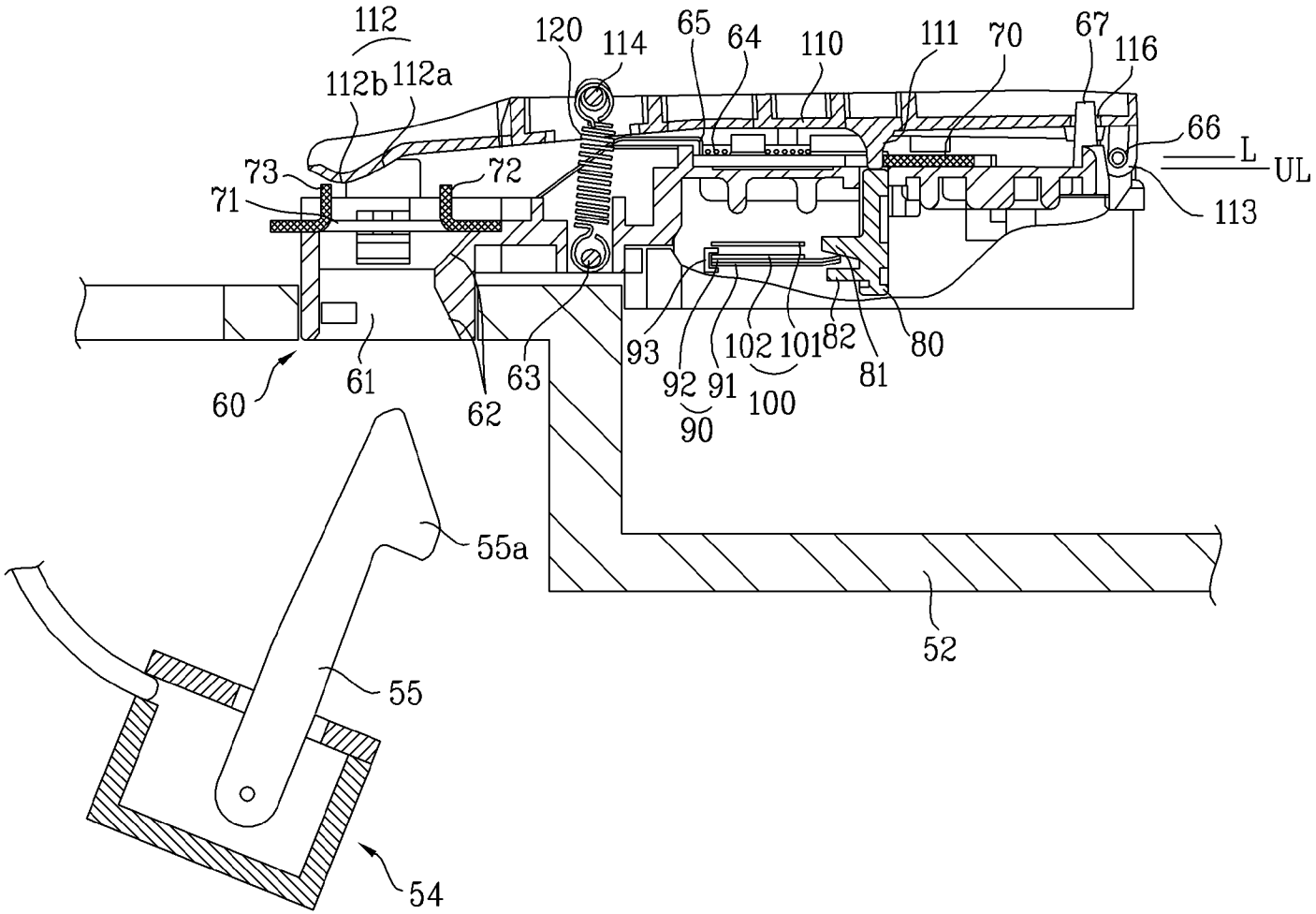
FIG. 7 illustrates a section of a door lock switch after forced opening of the door in FIG. 3.

FIG. 4 illustrates a section of a door lock switch at the time of unlocking of the door in FIG. 3, FIG. 5 illustrates a section of a door lock switch at the time of locking of the door in FIG. 3, FIG. 6 illustrates a section of a door lock switch at the time of forced opening of the door in FIG. 3, and FIG. 7 illustrates a section of a door lock switch after forced opening of the door in FIG. 3.

Referring to FIGS. 4 to 7, the door lock switch 50 includes a switch casing 60, a slider 70, a locking pin 80, a bimetal 90, a switch 100, a safety lever 110, and a return spring 120.

The switch casing 60 is mounted at one side of the opening 53 of the body 52.

The slider 70 is movably mounted in the switch casing 60 such that the hook 55 on the door 54 is held at, or released from the switch casing 60.

The locking pin 80 is provided for locking or unlocking of the slider 70.

The bimetal 90 is provided such that the locking pin 80 moves between a locking position 'L' and an unlocking position 'UL' of the slider 70.

The switch 100 is provided such that the locking pin 80 is come into contact therewith when the locking pin 80 moves to the locking position 'L' of the slider 70.

The safety lever 110 is provided such that the locking pin 80 moves for releasing contact of the switch 100 when the door 54 is opened forcibly.

The return spring 120 is provided such that the safety lever 110 has a restoring force in a direction the door 54 is opened.

Components of the door lock switch 50 will be described in more detail.

The switch casing 60 is secured to a side of the opening 53 in the body 52 with fastening means, such as fastening bolts. The switch casing 60 has an inserting hole 61 for inserting the hook 55, having a sloped side surface 62 for sliding of the hook 55. The switch casing 60 also has a return spring holding rod 63 for holding one end of the return spring 120. In the switch casing 60, there is a spring 64 which extends when the slider 70 moves away by the hook 55, and returns when the hook 55 is drawn from the inserting hole 54. In this instance, the spring 64 has one end held at a step 65 on the switch casing 60, and the other end held at the slider 70. The switch casing 60 has a hinge pin 66 at an opposite side of the inserting hole 61 for hinge connection of the safety lever 110. Moreover, the switch casing 60 has a safety lever retainer 67 projected therefrom for preventing the safety lever from falling off the switch casing 60.

The hook 55 is mounted on the door 54 so as to be rotatable at a predetermined angle, and is springly supported on a return spring (not shown) in the door 54.

The slider 70 has an inserting hole 71 for inserting the hook 55. The slider 70 has a first projection 72 formed by bending at one side of the inserting hole 71 such that the slider 70 is pushed away by the hook 55. Moreover, the slider 70 has a second projection 73 at the other side of the inserting hole 71 for limiting left/right direction movement of the hook 55 when the hook 55 is held from moving in a door opening direction.

The locking pin 80 has upper, and lower holders 81, and 82 for holding a portion of the bimetal 90 placed therebetween.

The bimetal 90 has two metal plates 91, and 92 of different thermal expansive coefficients in close contact with each other. The two metal plates 91, and 92 are designed to be heated by a heater 93 mounted in the switch casing 60. The two metal plates 91, and 92 have one ends fixedly secured to the heater 93 or the switch casing 60, and the other ends held between the upper, and lower holders 81, and 82. The heater 93 may be selected from a variety of heaters, such as a PTC ceramic heater, or a coil heater.

The switch 100 includes a fixed contact 101 electrically connected to the electric driving units mounted on the washing apparatus, and a movable contact 102 on the bimetal 90 electrically connected to a current supply portion (not shown) for supplying a current to the electric driving units.

The safety lever 110 has one end rotatably coupled to the switch casing 60, and the other end extended so as to be in contact with the hook 55, and one side having a projection 111 for pressing the locking pin 80. At the other end of the safety lever 110, there is also a rotation delay portion 112 for delaying rotation of the safety lever 110 when the door 54 starts to open, so that the slider 80 is not held at the projection 111. The rotation delay portion 112 includes a sloped portion 112*a* a head portion 55*a* of the hook 55 is to slide thereon, and a stepped portion 112*b* extended from the sloped portion 112*a* so as to be stepped from other portions of the safety lever. The safety lever 110 has a hinge hole portion 113 at one end thereof having the hinge pin 66 of the switch casing 80 rotatably inserted therein the safety lever 110 also has a return spring holding rod portion 114 for holding the other end of the return spring 120. The safety lever 110 has a holding hole 116 for holding the safety lever retainer 67 for limiting excessive rotation of the safety lever 110.

The operation of the door lock switch of a washing apparatus of the present invention will be described.

When the door 54 is rotated to close the opening 53 after laundry is introduced into the drum 56, the head portion 55*a* of the hook 55 passes through the inserting hole 61 in the switch casing 60, and the inserting hole 71 in the slider 70 in succession. As shown in FIG. 5, as the hook 55 passes through, the hook 55 makes the first projection 72 on the slider 70 to slide in a lateral direction, and pushes the safety lever 110 in a closing direction of the door 54, making the safety lever 110 rotates by a predetermined angle around the hinge pin 66.

Then, the slider 70 slides in a lateral direction by the hook 55, and extends the spring 64, such that the second projection 73 of the slider 70 reaches to a position at which, as shown in FIG. 5, the second projection 73 limits left/right direction movement of the hook 55, and the head portion 55*a* of the hook 55 is held at a side of the inserting hole 61 of the switching casing 60 from an opening direction of the door 54.

Then, when the user puts the washing apparatus into operation in a state the door 54 is locked thus, the washing apparatus locks the door 54, and senses the forced opening of the door 54, to cut a current to the electric driving units when the door 54 is opened forcibly.

Figure 8:
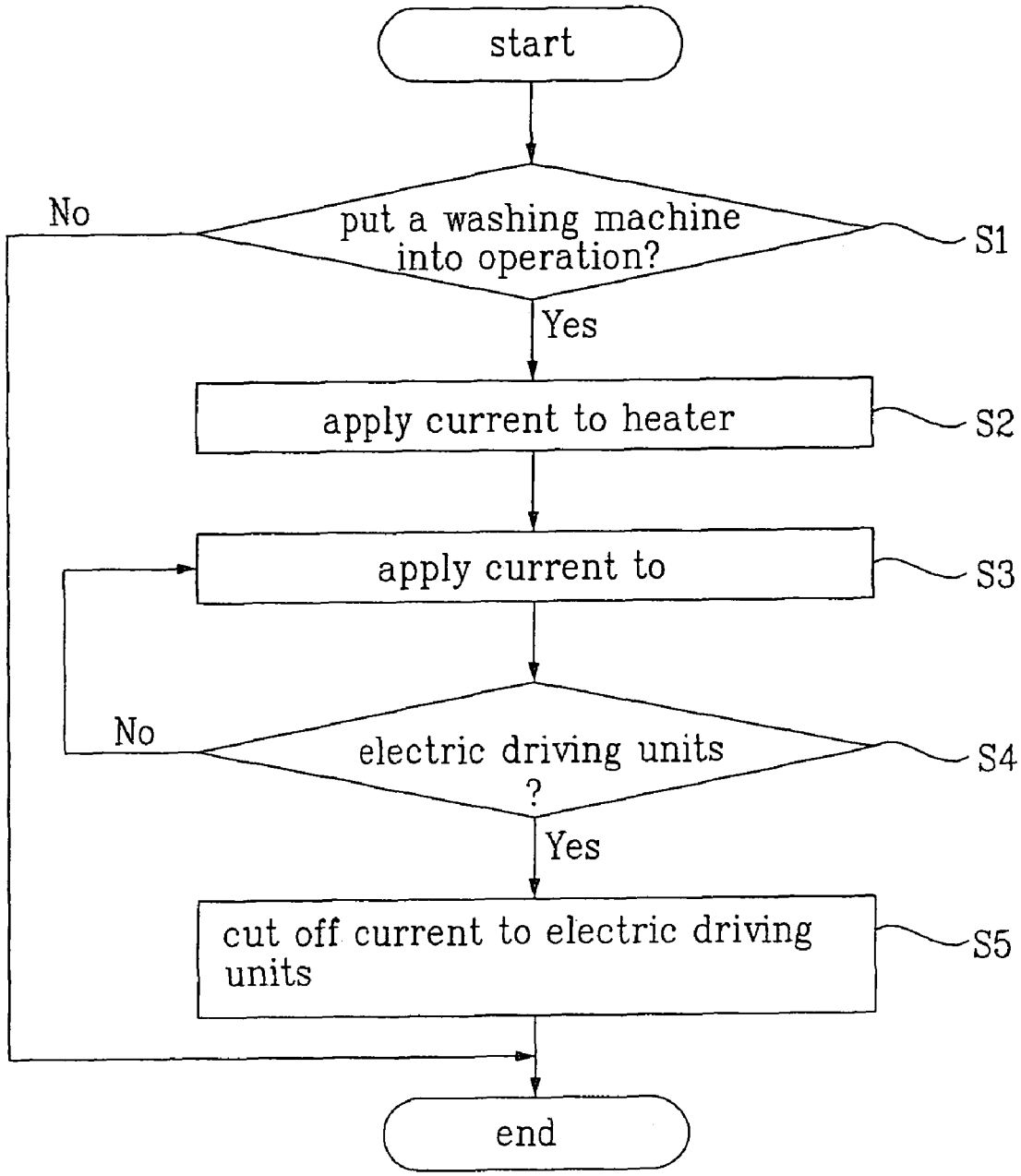
FIG. 8 illustrates a flow chart showing the steps of a method for controlling a washing apparatus in accordance with a preferred embodiment of the present invention.

FIG. 8 illustrates a flow chart showing the steps of a method for controlling a washing apparatus in accordance with a preferred embodiment of the present invention having the door lock switch applied thereto.

Referring to FIG. 8, the method includes a first step for locking a door 54 to close a switch 100, a second step for applying a current to electric driving units as the switch 100 is closed, a third step for opening the switch 100 as the door 54 is opened forcibly, and a fourth step for cutting off the current applied to the electric driving units as the switch 100 is opened.

In the first step, as the bimetal 90 deforms by heat following locking of the door 54, the locking pin 80 moves to a locking position 'L' of the slider 70 to close the switch 100.

The bimetal 90 is thermally deformed by the heat from the heater 93.

In the third step, as the door 54 is opened forcibly, the locking pin 80 is moved to the unlocking position 'UL' of the slider 70 by the safety lever 110 to open the switch 100.

The foregoing will be described in more detail.

When the user puts the washing apparatus into operation, the current is applied to the heater 93 to lock the door 54 (S1, and S2).

The heater 93 generates heat to heat the bimetal 90 when the current is applied thereto, and, as shown in FIG. 5, the bimetal 90 bends in a direction of a metal having a lower thermal expansive coefficient by a difference of thermal expansion of the two metal 91, and 92, when the movable contact 102 is brought into contact with the fixed contact 101, to close the switch 100.

When the switch 100 is closed, the current is applied to the motor, the water supply valve, or the drain unit of the washing apparatus (S3).

Referring to FIG. 5, while the bimetal 90 bends, the bimetal 90 makes the locking pin 80 to move to the slider locking position 'L', so that the slider 70 is held by the locking pin 80 at a position where the second projection 73 limits left/right direction movement of the hook 55 when the slider 70 is going to return to an original position, thereby maintaining the holding of the hook 55 and the locking of the door 54.

The washing apparatus proceeds various cycles of washing, rinsing, spinning, and drying applied by the user as the electric driving units are operated in a state the door 54 is locked.

Referring to FIG. 6, if the door 54 is pulled forward strongly in the middle of proceeding of above cycles, the hook 55 moves in a door open direction together with the door 54, such that the head portion 55*a* slides on the sloped portion 112*a* of the rotation delay portion 112 while the head portion 55*a* pushes the second projection 73 of the slider 70 in a direction opposite to a direction in a case the hook 55 is inserted until the head portion 55*a* is brought into contact with the stepped portion 112*b*.

Referring to FIG. 7, if the door 54 is kept pulled, the head portion 55*a* is drawn out of the inserting hole 71 in the slider 70, and the inserting hole 61 in the switch casing 60 in succession.

In this instance, the safety lever 110 is moved in the door open direction by compression of the return spring 120, the projection 111 presses down the locking pin 80 to make the locking pin 80 to move forward, the locking pin 80 deforms the bimetal 90 to a shape before the bimetal 90 is expanded (i.e., a shape not thermally expanded), when the contact between the fixed contact 101 and the movable contact 102 is broken, to make the switch 100 open (S4).

Once the switch 100 is opened, the current to the electric driving units of the washing apparatus is cut off, to stop operation of the electric driving units (S5).

Then, referring to FIG. 5, if the door 54 is rotated to close the opening 53, the head portion 55*a* of the hook 55 makes the first projection 72 of the slider 70 to slide in a lateral direction, until the second projection 73 limits the left/right direction movement of the hook 55. Then, the head portion 55*a* of the hook 55 pushes the safety lever 110 in a door close direction, such that the head portion 55*a* is held at an edge of the inserting hole 61 of the switch casing from a door open direction while the head portion 55*a* make to the safety lever 110 to rotate at a predetermined angle around the hinge pin 66.

At the time of rotation of the safety lever 110, the locking pin 80 pressed down by the projection 111 moves to a locking position 'L' of the slider 70 again by bending coming from thermal expansion of the bimetal 90, and the fixed contact 101 and the movable contact 102 are brought into contact again by the bending coming from thermal expansion of the bimetal 90, thereby closing the switch 100. Accordingly, the electric driving units of the washing apparatus become a state when the electric driving units are possible to receive the current from the current supply portion.

Then, when the user puts the washing machine into operation again, the electric driving units are operated again, to proceed a series of cycles of the washing, rinsing, spinning, and drying. When all the cycles entered by the user are finished, the heater 93 is turned off.

If the heater 93 is turned off, the bimetal 90 is cooled down and restores a shape before the thermal expansion (i.e., a shape not thermally expanded), the contact between the fixed contact 101 and the movable contact 102 is broken, to apply the current to the electric driving units no more, and the locking pin 80 moves to the unlocking position of the slider 70 by the bimetal 90.

If the user pulls the door 54 forward again for taking out the laundry, the head portion 55*a* of the hook 55 slides on the sloped portion 112*a* of the rotation delay portion 112 while the head portion 55*a* pushes the second projection 73 of the slider 70 in a direction opposite to a direction in a case the hook 55 is inserted until the head portion 55*a* is brought into contact with the stepped portion 112*b*, and is drawn out of the inserting hole 71 in the slider 70 and the inserting hole 61 in the switch casing 60, in succession.

Another embodiment of the present invention will be described with reference to FIGS. 9 to 12.

Figure 9:
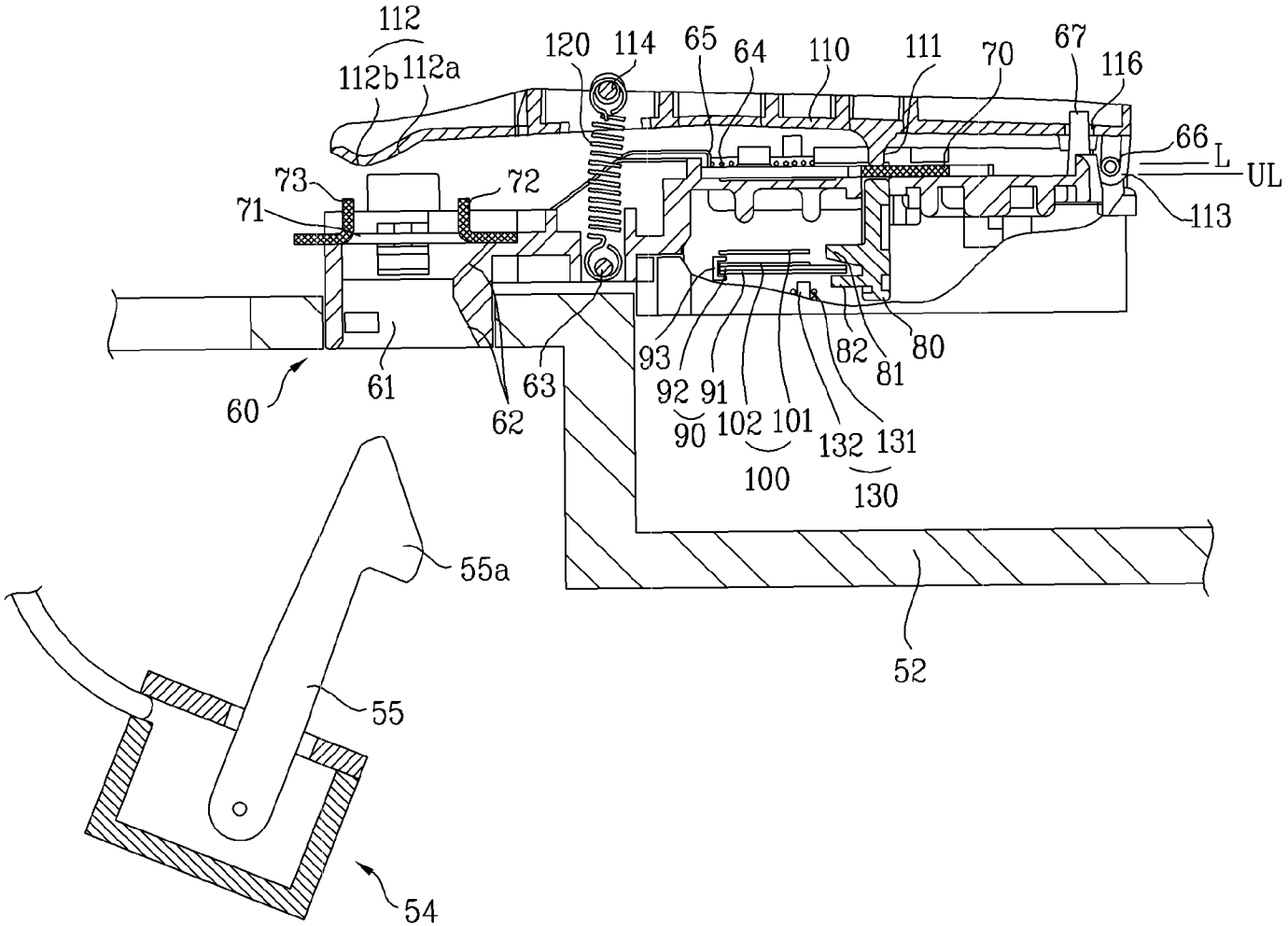
FIG. 9 illustrates a section of a door lock switch in accordance with another preferred embodiment of the present invention at the time of unlocking of the door.
Figure 10:
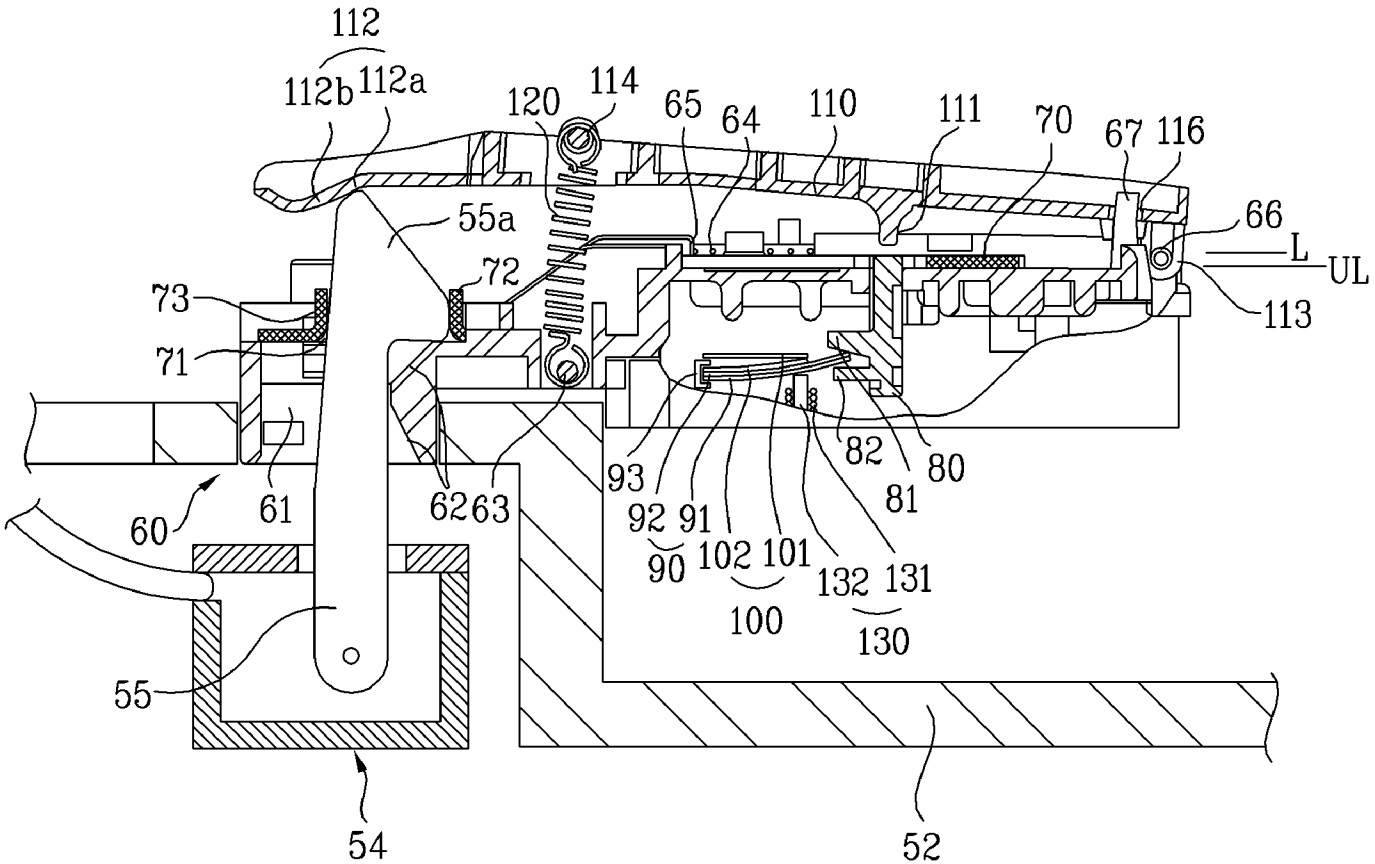
FIG. 10 illustrates a section of a door lock switch in FIG. 9 at the time of locking of the door.
Figure 11:
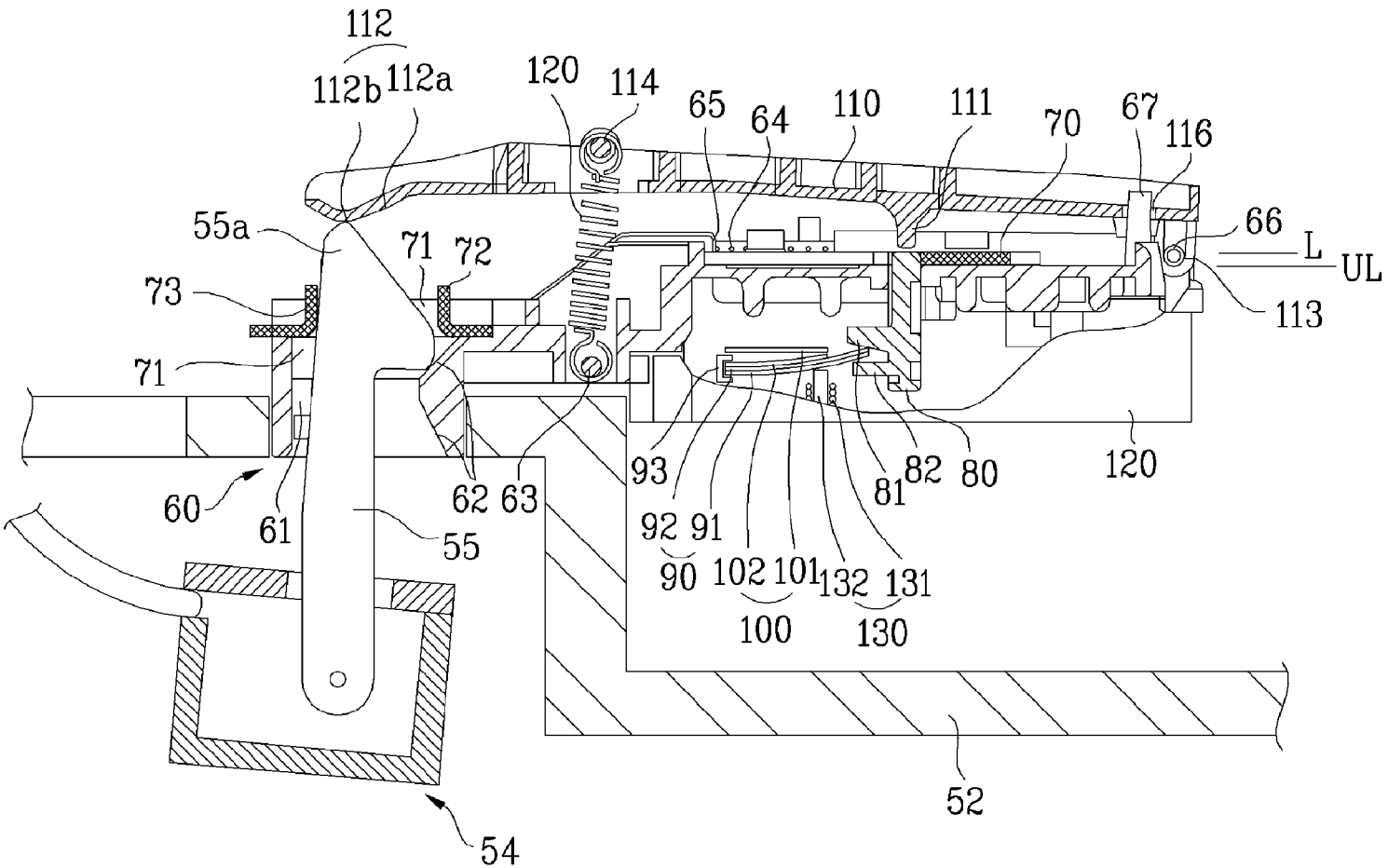
FIG. 11 illustrates a section of a door lock switch in FIG. 9 at the time of forced opening of the door.
Figure 12:
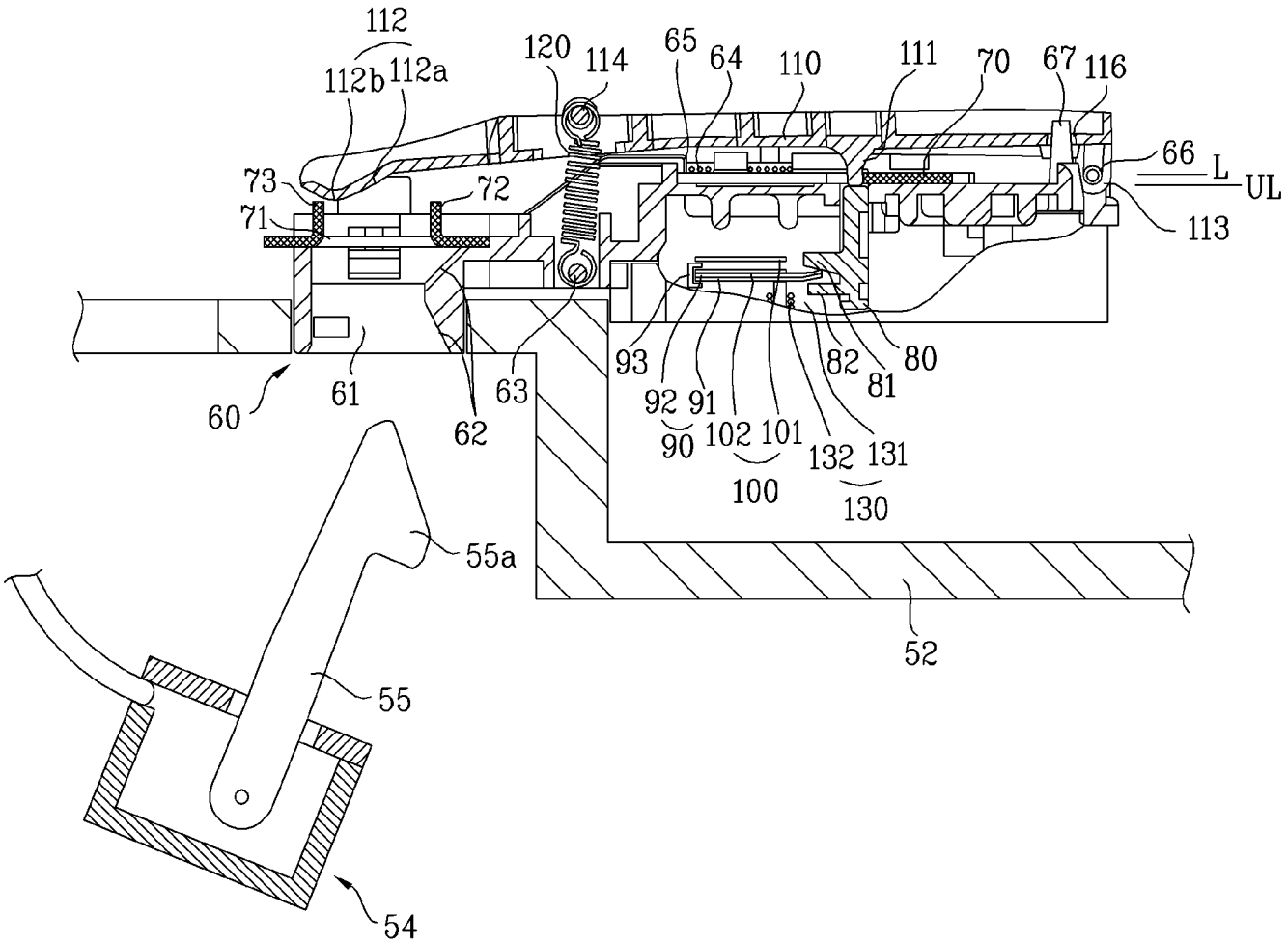
FIG. 12 illustrates a section of a door lock switch in FIG. 9 after forced opening of the door.
Figure 13:
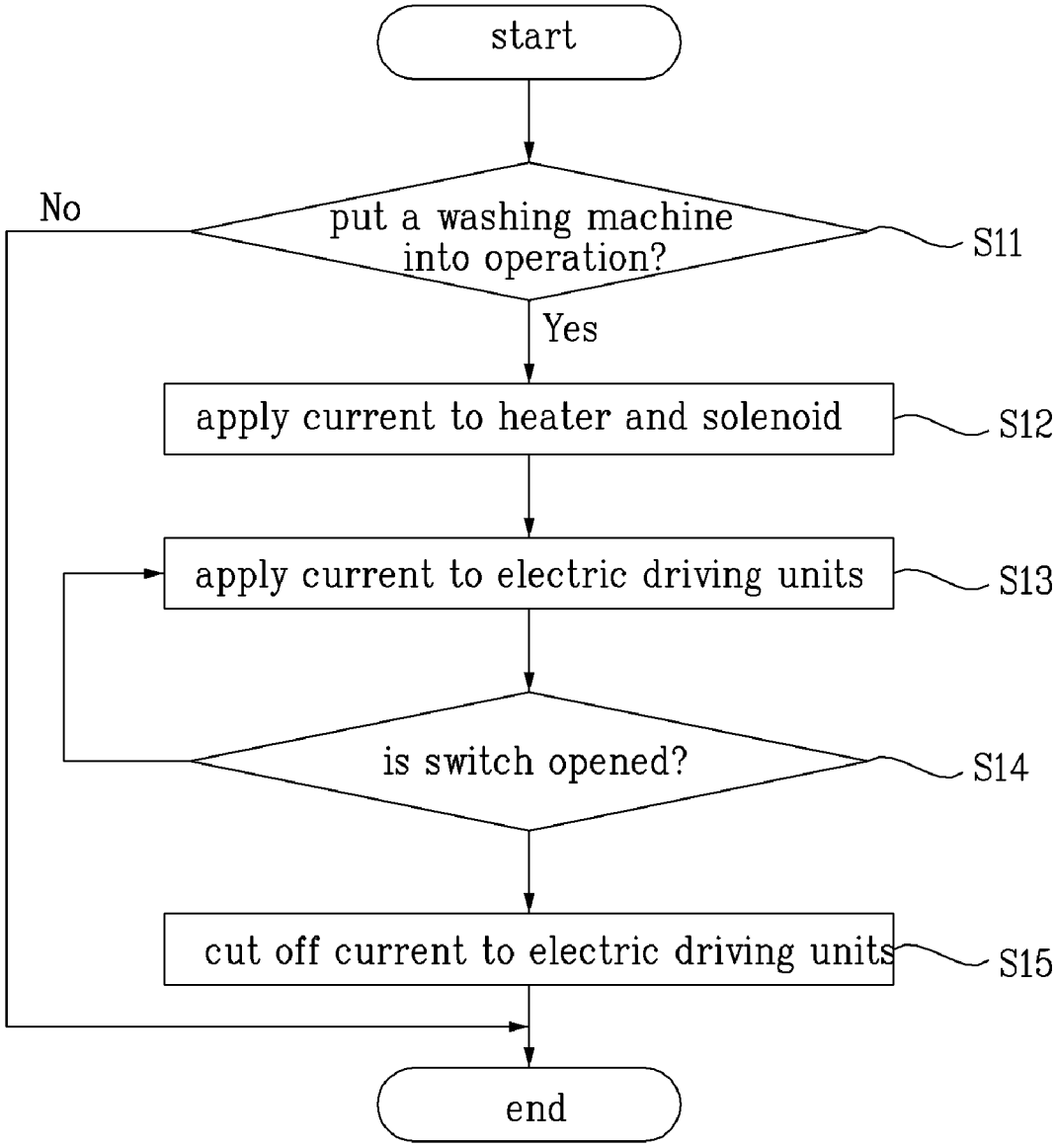
FIG. 13 illustrates a flow chart showing the steps of a method for controlling a washing apparatus in accordance with another preferred embodiment of the present invention.

FIG. 9 illustrates a section of a door lock switch in accordance with another preferred embodiment of the present invention at the time of unlocking of the door, FIG. 10 illustrates a section of a door lock switch in FIG. 9 at the time of locking of the door, FIG. 11 illustrates a section of a door lock switch in FIG. 9 at the time of forced opening of the door, FIG. 12 illustrates a section of a door lock switch in FIG. 9 after forced opening of the door, and FIG. 13 illustrates a flow chart showing the steps of a method for controlling a washing apparatus in accordance with another preferred embodiment of the present invention.

Referring to FIGS. 9 to 12, the door lock switch 50 further includes a solenoid 130 for deforming the bimetal to move the locking pin 80 between the locking position of the slider 70 and the unlocking position UL of the slider 70. Since other systems and operation except the solenoid are identical to the door lock switch in FIGS. 4 to 7, the same reference symbols will be used, and detailed description of which will be omitted.

The solenoid 130 includes a plunger 132 for deforming the bimetal 90 in response to a magnetic field, and a helical coil 131 wound on an outside surface of the plunger 132 for forming the magnetic field as a current is applied thereto.

That is, referring to FIG. 10, the door lock switch 50 makes the fixed contact 101 and the movable contact 102 to be brought into contact more quickly and more positively by applying a current to the coil 131 on the solenoid 130 when a current is applied to the heater 93, to make the plunger 132 to move forward, to bend one side of the bimetal 90 toward the fixed contact 101.

Referring to FIG. 12, when the locking pin 80 is forcibly pressed down by the projection 111 of the safety lever 110, the door lock switch 50 enables cutting off of the current by the safety lever 110 as the plunger 132 of the solenoid 130 is pressed down together with the bimetal 90.

In the meantime, FIG. 13 illustrates a flow chart showing the steps of a method for controlling a washing apparatus in accordance with another preferred embodiment of the present invention, having the door lock switch 50 in FIGS. 9 to 12 applied thereto.

Alike the foregoing control method, the method includes a first step for locking a door 54 to close a switch 100, a second step for applying a current to electric driving units as the switch 100 is closed, a third step for opening the switch 100 as the door 54 is opened forcibly, and a fourth step for cutting off the current applied to the electric driving units as the switch 100 is opened.

However, the first step in the method for controlling a washing apparatus in accordance with another embodiment of the present invention is different in closing the switch 100 by moving the locking pin 80 following the locking of the door 54.

That is, when the locking pin 80 is moved, not only the thermal deformation of the bimetal 90, but also the solenoid is used, for quicker closing of the switch 100.

The foregoing will be described in more detail.

When the user puts the washing apparatus into operation, the current is applied to the heater 93 and the solenoid 130 to lock the door 54 (S11, and S12).

The heater 93 generates heat to heat the bimetal 90 when the current is applied thereto, and, as shown in FIG. 10, the bimetal 90 bends in a direction of a metal having a lower thermal expansive coefficient by a difference of thermal expansion of the two metal 91, and 92, when the movable contact 102 is brought into contact with the fixed contact 101, to close the switch 100.

On the other hand, the solenoid 130 makes the fixed contact 101 and the movable contact 102 to come into quicker and more positive contact to each other as the plunger 132 moves forward to bend one side of the bimetal 90 toward the fixed contact 101.

When the switch 100 is closed, the current is applied to the motor, the water supply valve, or the drain unit of the washing apparatus (S13).

Referring to FIG. 12, while the bimetal 90 bends, the bimetal 90 makes the locking pin 80 to move to the slider locking position 'L', so that the slider 70 is held by the locking pin 80 at a position where the second projection 73 limits left/right direction movement of the hook 55 when the slider 70 is going to return to an original position, thereby maintaining the holding of the hook 55 and the locking of the door 54.

The washing apparatus proceeds various cycles of washing, rinsing, spinning, and drying applied by the user as the electric driving units are operated in a state the door 54 is locked.

Referring to FIG. 12, if the door 54 is pulled forward strongly in the middle of proceeding of above cycles, the head portion 55*a* of the hook 55 is drawn out of the inserting hole 71 in the slider 70, and the inserting hole 61 in the switch casing 60 in succession. In this instance, the safety lever 110 rotates in a door open direction to move the locking pin 80 forward through the projection 111, and the locking pin 80 deforms the bimetal 90 to a shape before the bimetal 90 is expanded (i.e., a shape not thermally expanded), when the contact between the fixed contact 101 and the movable contact 102 is broken, to make the switch 100 open (S14).

Once the switch 100 is opened, the current to the electric driving units of the washing apparatus is cut off, to stop operation of the electric driving units (S15).

As the operation hereafter is the same with the control method in FIG. 8, detailed description of which will be omitted.

Even though the door lock switch of a washing apparatus of the present invention has been described with reference to the attached drawings, it is apparent that the present invention is not limited to the embodiments and the drawings, but the present invention is applicable even to drying apparatus and dishwasher other than the washing apparatus.

INDUSTRIAL APPLICABILITY

According to the door lock switch of a washing apparatus, and method for controlling the same of the present invention, the direct sensing of forced opening of the door with the door lock switch which locks/unlocks the door, and cutting off of a current to the electric driving units under operation with the door lock switch permits a structure of the washing apparatus simple, and to improve operation efficiency and safety of the washing apparatus.

Moreover, the simplification of a structure of the washing apparatus for sensing forced open of the door permits to reduce assembly man-hours of the washing apparatus, as well as a fabrication time period and cost.

Thus, the door lock switch of a washing apparatus, and method for controlling the same of the present invention has very high industrial applicability.

The invention claimed is:

1. A method of responding to a forced removal of a latch from a casing during an operating cycle of a washing apparatus having a body forming an exterior thereof, electric driving units provided to the body, an opening in a front surface of the body, a door for opening/closing the opening, a door lock comprising the casing connected to the body, the latch removably and securedly received within the casing, the latch connected to the door, and a switch to interrupt power flow to the electric drive units if the door lock is unlocked during the operating cycle of the washing apparatus, the switch within the casing, the method comprising:

applying current to a heater to heat a bimetal component at a start of the operating cycle;

closing, by thermal deformation of the bimetal component resulting from heat generated by the heater, the switch to permit power flow to the electric drive units;

moving, by thermal deformation of the bimetal component resulting from heat generated by the heater, a locking pin coupled to the bimetal component from an unlocked position to a locked position, wherein:

when the latch is forcibly removed from the casing during the operating cycle, a safety lever, coupled to the latch when the latch is secured in the casing, moves the locking pin from the locked position to the unlocked position and, by movement of the locking pin to the unlocked position, moves the bimetal component to open the switch to interrupt power flow to the electric drive units regardless of whether current continues to be applied to the heater.

2. The method as claimed in claim 1, wherein the electric driving units are devices which use electricity as power sources including at least one of a motor for rotating a drum and a water supply valve for supplying water to a tub.

3. The method as claimed in claim 1, further comprising moving, by operating a solenoid, the bimetal component so as to make the locking pin move to the locked position by thermal deformation of the bimetal component and operation of the solenoid.

4. The method as claimed in claim 3, wherein the solenoid acts toward a direction of the thermal deformation of the bimetal component as a current is applied to the solenoid.

* * * * *